US009937610B2

(12) United States Patent
Wannaquot

(10) Patent No.: US 9,937,610 B2
(45) Date of Patent: Apr. 10, 2018

(54) ACCESSORIES FOR FASTENER DRIVING APPARATUS

(71) Applicant: Veetmano Wannaquot, Berkeley, CA (US)

(72) Inventor: Veetmano Wannaquot, Berkeley, CA (US)

( * ) Notice: Subject to any disclaimer, the term of this patent is extended or adjusted under 35 U.S.C. 154(b) by 579 days.

(21) Appl. No.: 13/727,763

(22) Filed: Dec. 27, 2012

(65) Prior Publication Data

US 2014/0183241 A1 Jul. 3, 2014

Related U.S. Application Data

(60) Provisional application No. 61/580,834, filed on Dec. 28, 2011.

(51) Int. Cl.

| | |
|---|---|
| ***B25C 7/00*** | (2006.01) |
| ***B25C 1/04*** | (2006.01) |
| *B25F 1/02* | (2006.01) |
| *B25F 3/00* | (2006.01) |

(52) U.S. Cl.

CPC ..... *B25C 7/00* (2013.01); *B25C 1/047* (2013.01); *B25F 1/02* (2013.01); *B25F 3/00* (2013.01)

(58) Field of Classification Search

None

See application file for complete search history.

(56) References Cited

U.S. PATENT DOCUMENTS 2,705,159 A * 3/1955 Pfau ..... F16L 37/23 137/614.03
2,716,393 A * 8/1955 Fischer ..... B25D 17/08 173/169
2,940,488 A * 6/1960 Riley, Jr. ..... B25B 23/0064 144/92
3,643,850 A * 2/1972 Endo ..... B25C 1/105 227/10
3,981,368 A * 9/1976 Lundstrom ..... E21B 6/00 173/104
4,299,021 A * 11/1981 Williams ..... B25C 1/02 227/113

(Continued)

FOREIGN PATENT DOCUMENTS

JP 04336984 A * 11/1992 ..... B25D 17/08

*Primary Examiner* — Hemant M Desai
*Assistant Examiner* — Mobeen Ahmed
(74) *Attorney, Agent, or Firm* — Jay Schloff; Aidenbaum Schloff and Bloom PLLC

(57) ABSTRACT

Accessories for a fastener driving apparatus are disclosed, which accessories may be removably attached to a fastener driving apparatus. An extension accessory increases the length of reach of a fastener driving apparatus by including an extension rod and further improves accuracy with regard to driving a fastener into a substrate via a fastener retention mechanism. A chisel accessory provides added versatility for a fastener driving apparatus by including a chisel tool function in addition to a fastener driving function. A fastener setting accessory improves fastener driving ease and accuracy by driving fasteners presently in a substrate to a specific depth. The accessories are specifically designed to transmit an uninterrupted force from the fastener driving apparatus to a fastener or chisel for driving a fastener into or otherwise impacting or striking a substrate.

15 Claims, 13 Drawing Sheets

(56) References Cited

U.S. PATENT DOCUMENTS 4,416,338 A * 11/1983 Nelson ..... B25D 9/16 173/169
4,905,548 A * 3/1990 Colace ..... B25B 13/481 81/177.2
4,960,015 A * 10/1990 Mathews ..... B25B 13/481 16/429
5,112,156 A * 5/1992 Boyer ..... F16B 7/0413 403/287
5,168,782 A * 12/1992 Cromwell ..... B25B 23/0021 81/177.2
5,289,745 A * 3/1994 Beardsley ..... B25B 23/0021 81/177.2
5,471,899 A * 12/1995 Twomlow ..... B25G 1/043 403/109.3
5,934,384 A * 8/1999 Wang ..... B25B 21/007 173/132
6,055,887 A * 5/2000 Galat ..... B25B 21/002 81/177.2
6,668,941 B2 * 12/2003 Phillips ..... B25B 23/005 173/29
6,840,142 B2 * 1/2005 Cheng ..... B25B 23/0021 279/81
7,032,797 B2 * 4/2006 Liao ..... B25C 1/008 227/142
7,287,681 B1 * 10/2007 Wen ..... B25C 1/003 227/120
7,410,084 B1 * 8/2008 Reed ..... B25C 1/00 173/202
7,997,169 B1 * 8/2011 Hack ..... B25B 13/06 81/177.2
2004/0093997 A1 * 5/2004 Huang ..... B25B 15/001 81/125
2004/0103761 A1 * 6/2004 Pillow ..... B25B 21/00 81/57.12
2007/0057009 A1 * 3/2007 Thorne ..... B25C 7/00 227/120
2007/0199970 A1 * 8/2007 Chen ..... B25C 1/008 227/107
2007/0278276 A1 * 12/2007 Wen ..... B25C 1/00 227/130
2009/0166394 A1 * 7/2009 Gyorkos ..... B25C 1/04 227/142
2010/0084451 A1 * 4/2010 Abla ..... B25C 1/00 227/107
2010/0224038 A1 * 9/2010 Evatt ..... B25B 15/001 81/429

* cited by examiner

NEW SHEET

NEW SHEET

ACCESSORIES FOR FASTENER DRIVING APPARATUS

CROSS-REFERENCE TO RELATED APPLICATIONS

The present disclosure claims priority under 35 U.S.C. § 119 on the U.S. Provisional Patent Application Ser. No. 61/580,834, filed on Dec. 28, 2011, the disclosure of which is incorporated herein by reference.

FIELD OF THE DISCLOSURE

The present disclosure relates to a fastener driving apparatus, and more particularly, to accessories for a fastener driving apparatus.

BACKGROUND

Fastener driving apparatuses, such as those apparatuses commonly known as "palm nailers," are used as a matter of course in the construction or home improvement process. The apparatuses allow a user to accomplish tasks more quickly, and also allow a user to accomplish tasks that are otherwise not performable without a tool, such as driving nails into a surface. Palm nailers are particularly advantageous in allowing a user to drive a fastener into a surface in an area where the user otherwise does not have room to swing a hammer or use a traditionally-sized "nail gun."

A palm nailer may be held in one's hand and may drive nails after it is connected to an energy source, such as an air compressor or battery. The palm nailer has a sleeve that may be positioned over a fastener, which sleeve includes a nailing pin that impacts the fastener after being subjected to a force generated by a piston from the energy source to drive the fastener into a substrate. To apply the generated force, the user presses on the sleeve to open a valve, which either allows compressed air into the sleeve and onto the nailing pin or completes a circuit with the battery to so do. The sleeve usually also features a magnetic element thereon for holding the fastener in a position in or by the sleeve before the force is exerted, and a spring for providing a bias on the nailing pin or fastener.

While palm nailers have their advantages, they are limited in their realm of use due to their current configuration. For instance, the reach of a palm nailer is limited to the length of its sleeve and to the length of the user's arm. In this regard, it is difficult to use a palm nailer to drive a fastener into a point near or on a ceiling. Further, the configuration of the sleeve and magnetic element thereon have drawbacks in that they do not allow for precise positioning of a fastener with respect to the rest of the palm nailer and/or to the surface into which the fastener is to be driven before the fastener is driven by the nailing pin. Moreover, in that a palm nailer may require striking a fastener a number of times to drive it into a substrate, a palm nailer may imprecisely seat a substrate if the user is unable to determine easily whether the fastener has been seated at a preferable depth in the substrate.

Accordingly, there exists a need for accessories for fastener driving apparatuses, and particularly for palm nailers, that increase the versatility and accuracy of operation of a fastener driving apparatus.

SUMMARY OF THE DISCLOSURE

In light of the disadvantages of the prior art, it is an object of the present disclosure to obviate above and other disadvantages from existing art and to provide for accessories for a fastener driving apparatus that overcome all of the disadvantages of the prior art, while still maintaining the advantages of the prior art.

It is accordingly an object of the present to provide for an extension for fastener driving apparatuses that facilitates use of a fastener driver in previously-hard-to-reach places. It is further an object of the present invention to include a chisel attachment that may be removably installed on a fastener driver. It is yet another object of the present disclosure to provide a fastener setter for a fastener driving apparatus that allows the user to drive a fastener presently in a substrate with precision and to a specific depth selected by the user.

In an embodiment, various accessories for use with a fastener driving apparatus are disclosed herein. In an embodiment, an accessory comprises an extension accessory, which extension accessory allows for improved driving of fasteners by providing additional length to the reach of a fastener driving apparatus. In this way, the fastener driving apparatus may drive fasteners in spaces that were previously unreachable or otherwise reachable only with the use of a ladder or scaffolding. In an embodiment, the extension accessory comprises an extension rod, an elongate component that provides most of the added length of the fastener driving apparatus' reach, and a plurality of extension rods may be used with one fastener driving apparatus to create as large of a reach as necessary for the fastener driving apparatus. Further, the extension accessory allows the force from the nailing pin of the fastener driving apparatus to transmit uninterruptedly to a striker element, which utilizes that force to drive a fastener into a substrate.

In another embodiment, a chisel accessory is disclosed, which increases the versatility of a fastener driving apparatus to which it is attached by allowing a chisel to be operatively coupled thereto. The chisel accessory allows the fastener driving apparatus to be used as a chisel in addition to a fastener driver. In an embodiment, a chisel is connected to a fastener driving apparatus with an attachment kit. The chisel accessory also may comprise an elongate extension rod, which may be further extended through the addition of multiple such extension rods, and allows the force from the nailing pin of the fastener driving apparatus to transmit uninterruptedly to the chisel for the impacting on and breaking up of a surface.

In another embodiment, a fastener setting accessory is disclosed, which provides for improved ease and accuracy for driving a fastener, including a fastener that may already be disposed within a substrate to a desired depth within the substrate. A depth guide of the fastener setting accessory comprises, in an embodiment, a plurality of viewing windows, each of which indicating a specific depth to which the pre-existing fastener may be driven into a substrate and may be selected by rotating the depth guide until the viewing window corresponding to the select depth is retained in a use position. An elevated ridge piece may further prevent the head or flange of the nail from being driven farther than desired. The fastener setting accessory also may comprise an elongate extension rod (or multiple such extension rods) and similarly allows the force from the nailing pin of the fastener driving apparatus to transmit uninterruptedly to a striker for the impacting on and driving of a fastener.

The accessories herein disclosed address the various shortcomings of the prior art by providing improved reach, versatility, and accuracy to a fastener driving apparatus to which they may be attached. The accessories for fastener driving apparatuses herein disclosed do not detract from such an apparatus' ability to drive fasteners in tight spaces or spaces that are so dimensioned to prohibit the use of a hammer, nor do they detract from the other advantages of such apparatuses that have previously been established.

DESCRIPTION OF THE DRAWINGS

The advantages and features of the present disclosure will become better understood with reference to the following detailed description and claims taken in conjunction with the accompanying drawings, wherein like elements are identified with like symbols, and in which:

Like reference numerals refer to like parts throughout the description of several views of the drawings.

DETAILED DESCRIPTION OF THE DISCLOSURE

The best mode for carrying out the disclosure is presented in terms of its preferred embodiment, herein depicted in the accompanying figures. The preferred embodiments described here in detail for illustrative purposes are subject to many variations. It is understood that various omissions, substitutions of equivalents are contemplated as circumstances may suggest or render expedient, but is intended to cover the application or implementation without departing from the spirit or scope of the claims of the present disclosure. As used herein, the terms "a" and "an" herein do not denote a limitation of quantity, but rather denote the presence of at least one of the referenced item.

The present disclosure provides for accessories for a fastener driving apparatus, and in an embodiment, specifically for palm nailers. The accessories include at least an extension attachment for a fastener driving apparatus, a chisel attachment for a fastener driving apparatus, and a fastener setting attachment for a fastener driving apparatus. The various accessories disclosed herein facilitate in the operation of fastener driving apparatuses and make the performance of such apparatuses more versatile.

A fastener driving apparatus is used to drive a fastener, such as a nail, into a substrate. Many types of fastener driving apparatuses are presently available on the market, one of which being the palm nailer, which is a pressure-based hand tool chosen by many for precision fastening work. After connecting the palm nailer to an energy source, such as an air compressor or a battery, a nail is loaded carefully into an opening at the end of the apparatus, which nail is held in place by fastener guide and fastener retention mechanism components. Once the palm nailer is ready for operation and is brought to the desired fastening location on a substrate, a downward force is applied by the user onto the surface of the apparatus that is distal from the nail. This downward force causes the energy source to transmit energy to a piston in the apparatus, which uses that energy to generate a high-pressure force that is translated through the apparatus and drives the nail into the substrate. Palm nailers are preferable tools in this regard because they require little physical application by the user to drive a fastener through a substrate.

Figure 1:
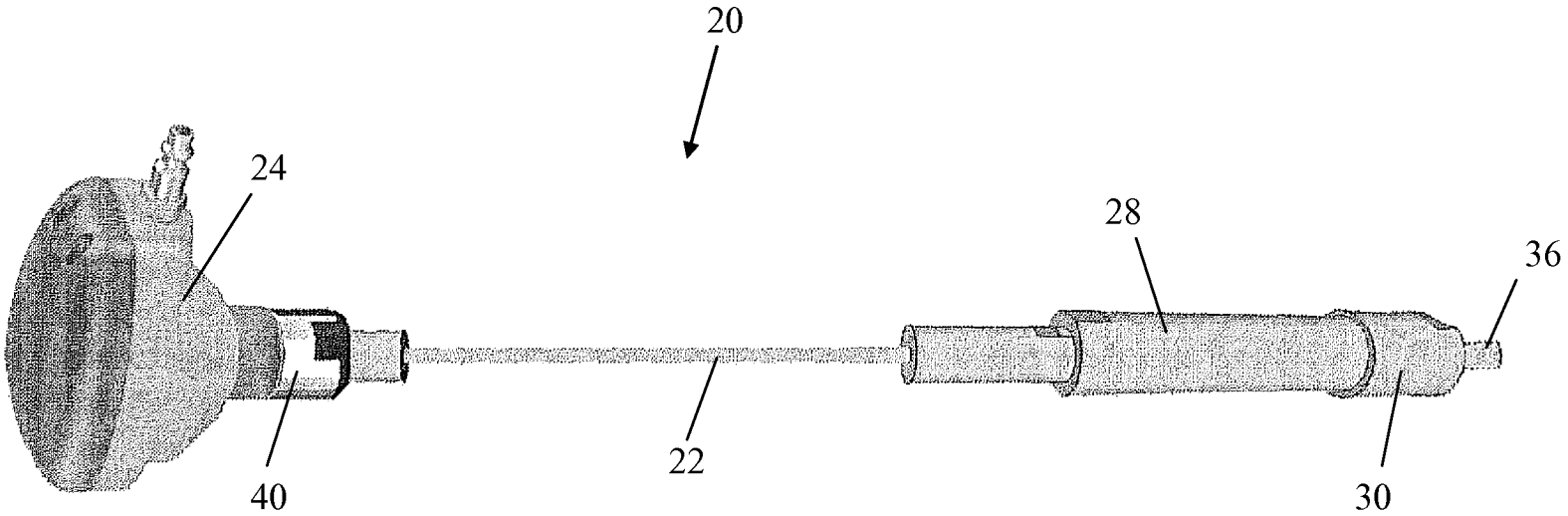
FIG. 1 illustrates a perspective view of a fastener driving apparatus assembled with an extension accessory, in accordance with an exemplary embodiment of the present disclosure.
Figure 2:
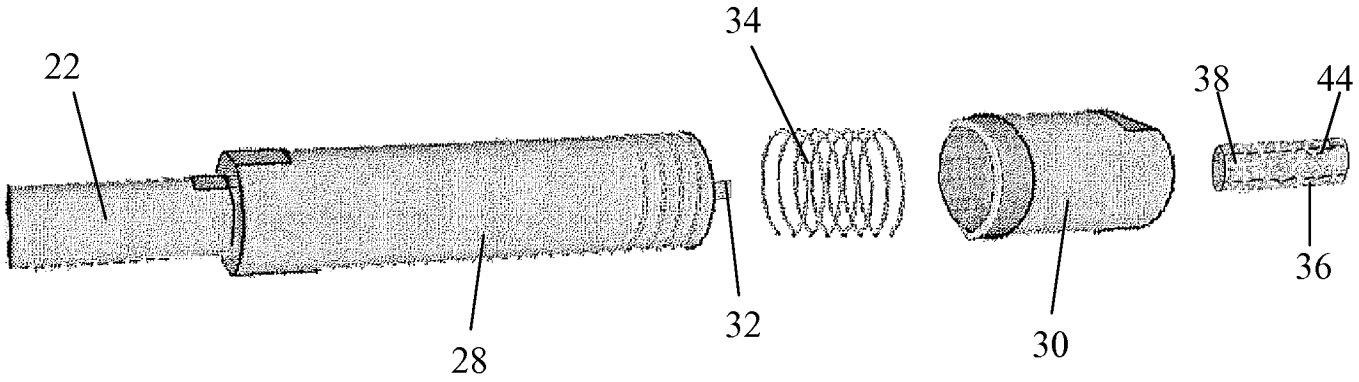
FIG. 2 illustrates a perspective, semi-exploded view of the components of an extension accessory wherein certain inner components are shown in phantom, in accordance with an exemplary embodiment of the present disclosure.

Referring now to FIGS. 1 and 2, and in an embodiment, an extension accessory 20 comprises an elongate device that may be removably attached to a fastener driving apparatus 24. The extension accessory 20 allows the apparatus 24 to drive a fastener into a substrate, when such fastener is disposed at the end of the extension accessory 20 that is distal to the apparatus 24. The extension accessory 20 is operatively coupled to the apparatus 24 such that the extension accessory 20 increases the reach of the apparatus 24. In an embodiment, the extension accessory 20 comprises an extension rod 22, which adds to the reach of the apparatus 24. As will be discussed below, the extension rod 22 may comprise a locking mechanism 26 at a proximate end, which helps to secure the extension accessory 20 to the apparatus 24. At a distal end of the extension rod 22 is a body piece 28. In an embodiment, the body piece 28 may be fixedly disposed at on the extension rod 22. In another embodiment, the body piece 28 may be removably attached to the extension rod 22. The cap piece 30 may be screwed onto the body piece 28 and may be securely tightened using a force-exerting tool, such as a wrench.

The cap piece 30 may securely fasten other components, such as a sleeve 36 and biasing member 34 (discussed in more detail below), to the extension rod 22 and body piece 28. The cap piece 30 may further be configured to assist in accurate driving of the fastener into a substrate. The cap piece 30 may be of particular dimensions that correspond to the dimensions of the particular fastener to be driven by the apparatus 24 and extension accessory 20. In an embodiment, the cap piece 30 may be configured to drive duplex nails such that only the first collar of the duplex nail is driven into a substrate, and the second collar remains above the substrate, rather than being driven into the substrate as well.

A striker 32 and the sleeve 36 are preferably disposed within at least a portion of the body piece 28 and cap piece 30. The striker 32 is fixedly disposed against a proximate end of the body piece 28 and, in an embodiment, comprises an elongate anvil element that strikes the fastener when a force is applied to it. The sleeve 36 is hollow and includes a fastener guide 38 and a fastener retention mechanism 44, which each facilitate in retaining a fastener in position until it is driven by the apparatus 24 into a substrate. In an embodiment, the fastener retention mechanism 44 is a magnet disposed within, along the inside wall of, about, or outside of the sleeve 36. In a further embodiment, the fastener retention mechanism 44 is a foam washer disposed along the inside wall of the sleeve 36. In a further embodiment, the fastener guide 38 fits within and is disposed along the entire length of the sleeve 36.

A biasing member 34 may be disposed within at least a portion of the body piece 28 and cap piece 30. The biasing member 34 provides support for the sleeve 36 and ensures that the fastener guide 38 properly guides the fastener within the sleeve 36 by allowing the sleeve 36 to move towards the proximate end of the extension accessory 20 such that the striker 32 may enter the hollow opening of the sleeve 36. This movement allows the striker 32 to strike the fastener with substantially the full amount of force generated by the piston of the apparatus 24 so as to drive the fastener into a substrate. The biasing member 34 may also, at rest, retain the sleeve 36 in a retracted position wherein the sleeve 36 is disposed beyond the distal end of the cap piece 30. In an embodiment, the proximate end of the biasing member 34 is disposed against the proximate end of the body piece 28 and fits around the striker 32, and the distal end of the biasing member 34 is operatively coupled to the sleeve 36. In one embodiment, the biasing member 34 is a spring.

Figure 3:
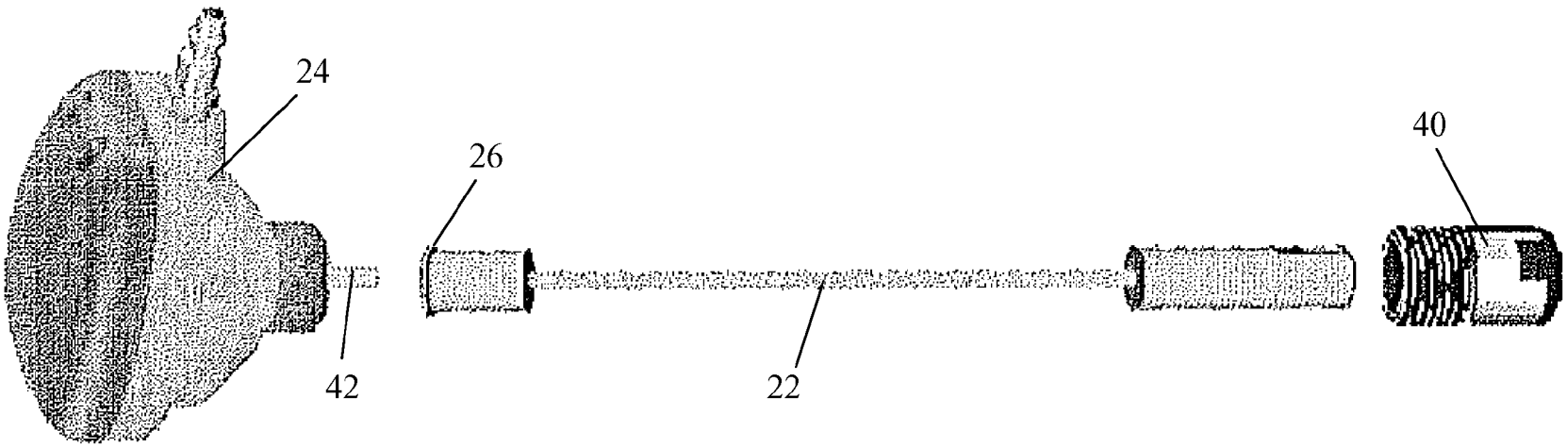
FIG. 3 illustrates a perspective view of an extension accessory becoming attached to a fastener driving apparatus, in accordance with an exemplary embodiment of the present disclosure.
Figure 3A:
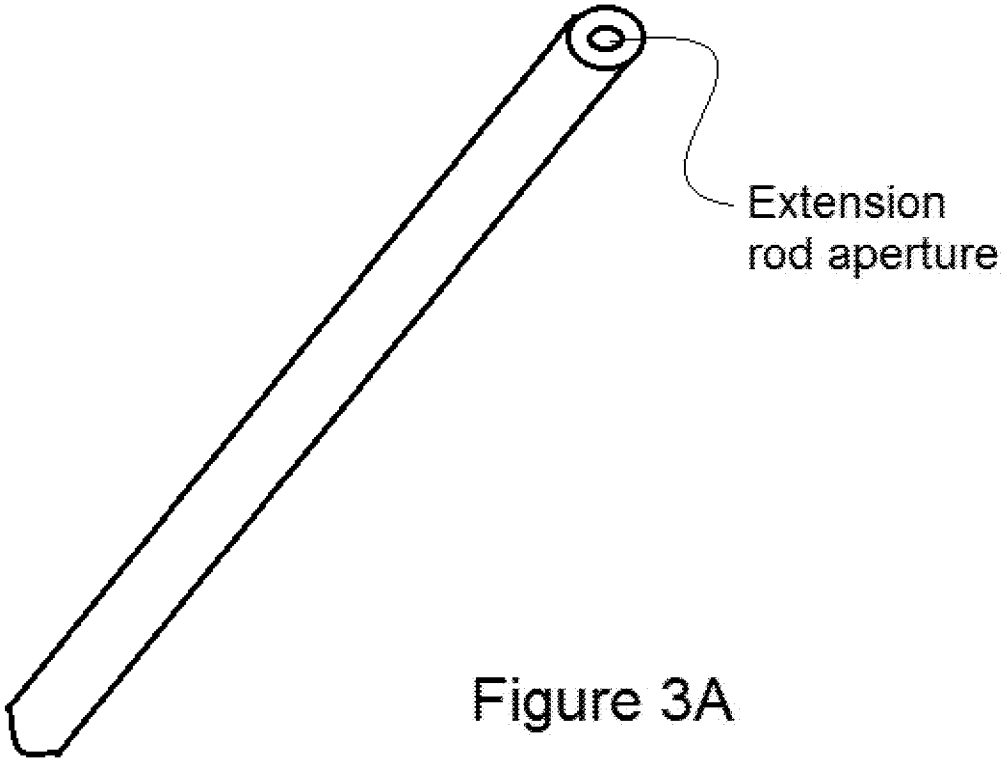
FIG. 3A illustrates an aperture of an extension rod, in accordance with an exemplary embodiment of the present disclosure.
Figure 4:
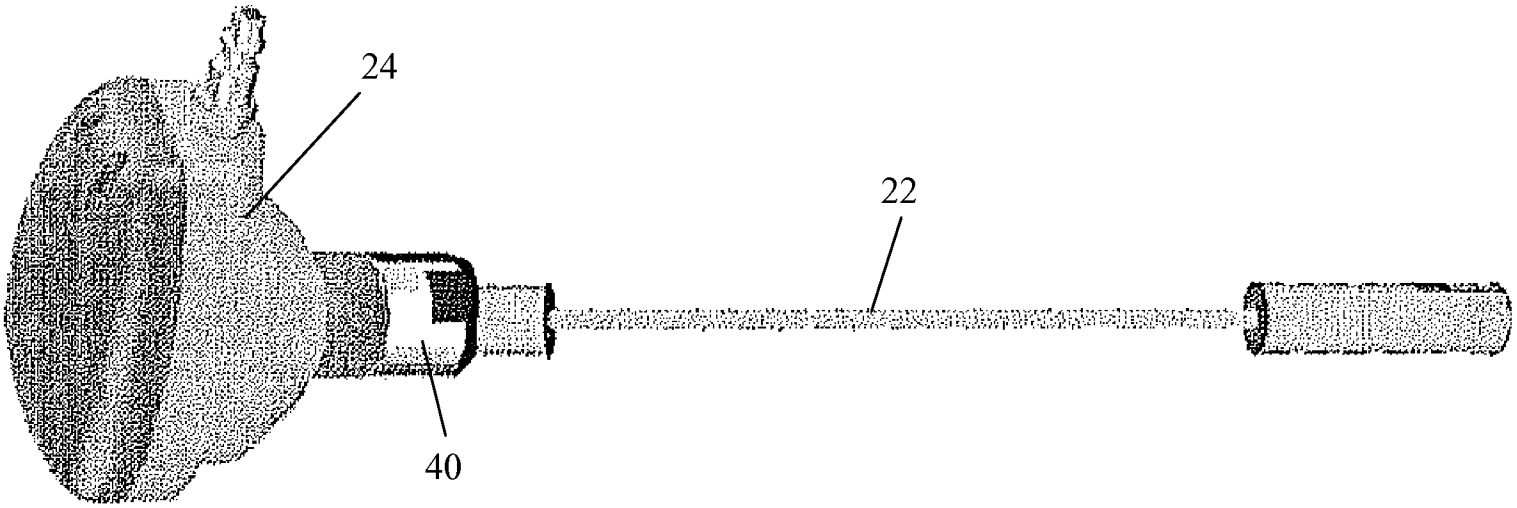
FIG. 4 illustrates a perspective view of an extension accessory having just become attached to a fastener driving apparatus, in accordance with an exemplary embodiment of the present disclosure.

In an embodiment wherein the fastener driving apparatus 24 is a palm nailer, FIGS. 3 and 4 illustrate how the extension accessory 20 operatively attaches to the apparatus 24. It will be apparent that originally attached to the apparatus 24 is a magnetic nail guide holder 40, which is threadably removed from the apparatus 24 before attaching the extension accessory 20 thereto. The extension accessory 20 is placed with its proximate end adjacent to the apparatus 24 such that a nailing pin 42 of the apparatus 24 enters a small aperture (shown in FIG. 3A) within the extension rod 22 and such that a locking mechanism 26 may be disposed adjacent to the portion of the apparatus 24 from which the magnetic nail guide holder 40 was removed. The magnetic nail guide holder 40 slides over the in-place extension rod 22 to become threadably reattached at its original location in the apparatus 24.

Figure 2B:
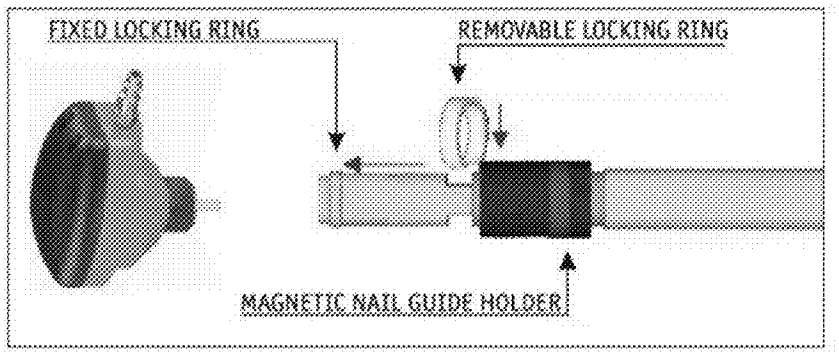
FIGS. 2A and 2B illustrate a static locking ring and a removable locking ring, in accordance with an exemplary embodiment of the present disclosure.
Figure 2A:
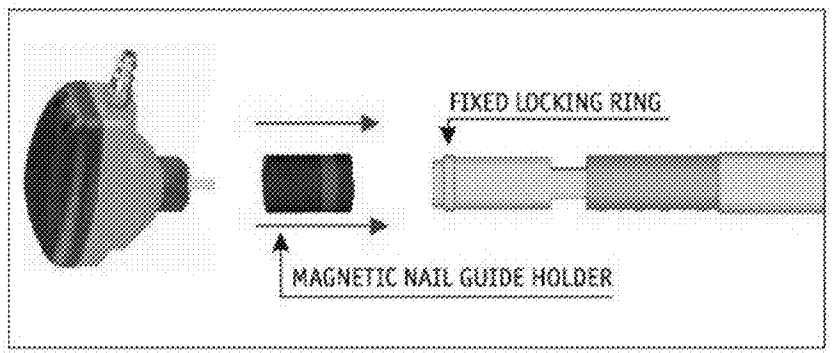

In an embodiment, the locking mechanism 26 is a static locking ring fixedly disposed on the proximate end of the extension rod 22, which sits within the tapered, hollow center of the magnetic nail guide holder 40 and prevents the extension rod 22 from falling out of place. In another embodiment, the locking mechanism 26 is a removable locking ring that is placed around a groove in the extension rod 22 to become attached thereto and that may also sit within the tapered, hollow center of the magnetic nail guide holder 40 for preventing the extension rod 22 from falling out of place. In a further embodiment, the locking mechanism 26 is both a static locking ring and a removable locking ring (shown in FIGS. 2A and 2B).

In use, the extension accessory 20 so attached may transfer force generated by the piston of the apparatus 24 over an elongate portion such that a fastener disposed at an end of the extension accessory 20 distal from the apparatus 24 may be driven into a substrate using that force. The extension accessory 20 is designed such that the full force originally exerted by the apparatus 24 (or substantially such full force) on the extension rod 22 is used to drive the fastener. In an embodiment wherein the apparatus 24 is a palm nailer, a piston of the apparatus 24 generates a force from energy received by an attached energy source, such as an air compressor or a battery, which force causes the nailing pin 42 of the apparatus 24 to thrust forward within an aperture of the extension rod 22 toward the rod 22. The extension rod 22 receives the force from the nailing pin 42 and translates it to the striker 32, which, once the sleeve 36 retracts towards the striker 32, immediately and directly transfers the force to the fastener that is then driven into a substrate.

Figure 5:
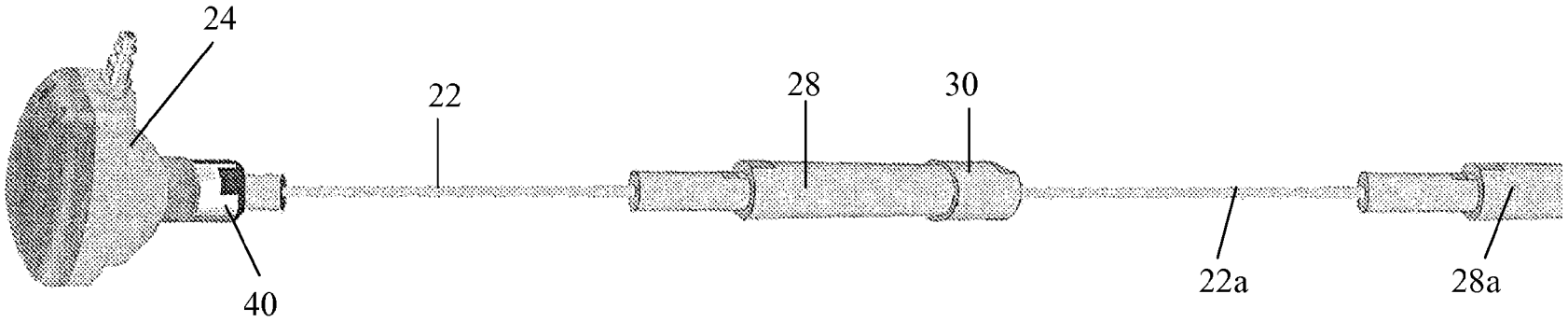
FIG. 5 illustrates a perspective view of an extension accessory wherein multiple extension rods and body pieces are connected, in accordance with an exemplary embodiment of the present disclosure.

In an embodiment, a plurality of extension rods 22 and body pieces 28 may attach to one another to further extend the effective length and driving capability of an apparatus 24 utilizing the extension accessory 20, as is depicted in FIG. 5. To attach a second extension rod 22*a* and second body piece 28*a* to a first extension rod 22 and body piece 28, the cap piece 30, biasing member 34, and sleeve 36 are first removed. The second extension rod 22*a* is placed with its proximate end adjacent to the first body piece 28 such that the striker 32 of the first body piece 28 enters the small aperture within the proximate end of the second extension rod 22*a* and such that the locking mechanism 26 of the second extension rod 22*a* may be disposed within the first body piece 28. The cap piece 30 of the first extension accessory 20 is then threadably reattached in its original position, thereby securing the second extension rod 22*a* in place. It will be apparent that the plurality of extension rods 22 and body pieces 28 that are attached to one another are so attached to allow the force generated by the piston of the apparatus 24 to be translated uninterruptedly to the striker 32. In this way, the force of the striker 32 on the fastener is translated from the apparatus 24 successively through the various extension rods 22 until it reaches the striker 32 that is direct contact with a fastener for driving that fastener into a substrate.

Figure 6:
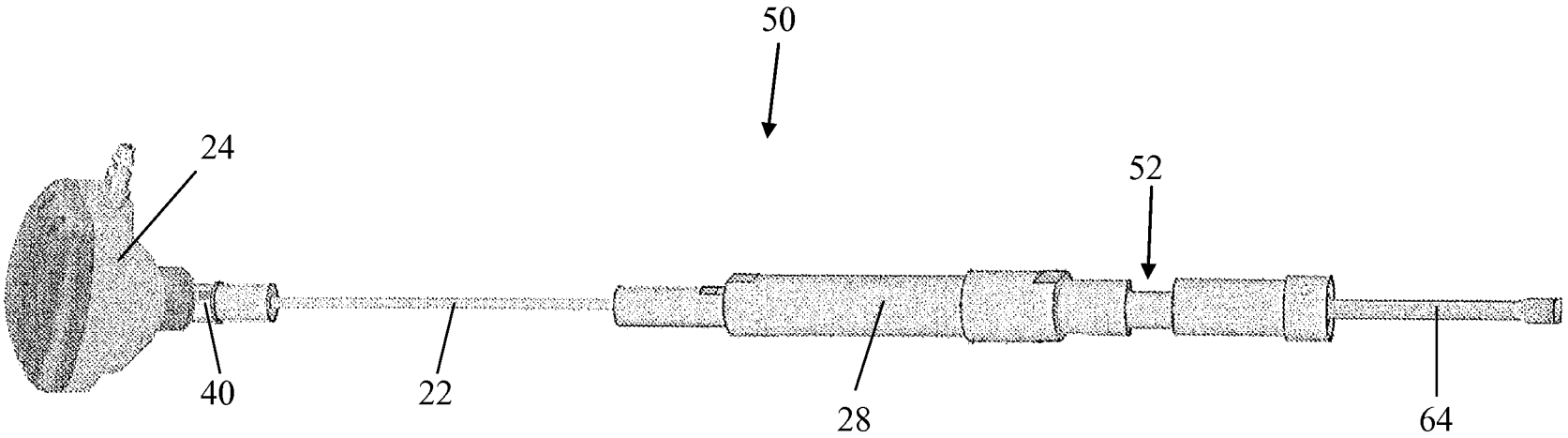
FIG. 6 illustrates a perspective view of a fastener driving apparatus assembled with a chisel accessory, in accordance with an exemplary embodiment of the present disclosure.

Referring now to FIG. 6, a chisel accessory 50 comprises an elongate device that may be removably attached to a fastener driving apparatus 24. The chisel accessory 50 may be operatively coupled to the apparatus 24 to allow the apparatus 24 to function as a chisel tool in addition to a fastener driver by imparting an impacting or driving force on the chisel accessory. In an embodiment, the chisel accessory 50 comprises an extension rod 22, which provides additional length to the reach of the apparatus 24 for chiseling. At a distal end of the extension rod 22 is a body piece 28. In an embodiment, the body piece 28 may be fixedly disposed at on the extension rod 22. In a further embodiment, the body piece 28 may be removably attached to the extension rod 22. The chisel accessory 50 may be operatively coupled to the fastener driving apparatus 24 in a similar fashion as is done with the extension accessory (as discussed above). Further, the extension rod 22 of the chisel accessory 50 may utilize a locking mechanism similar to that of the extension accessory, which may facilitate securing the chisel accessory 50 to the apparatus 24 within the magnetic nail guide holder 40 thereof.

Figure 7:
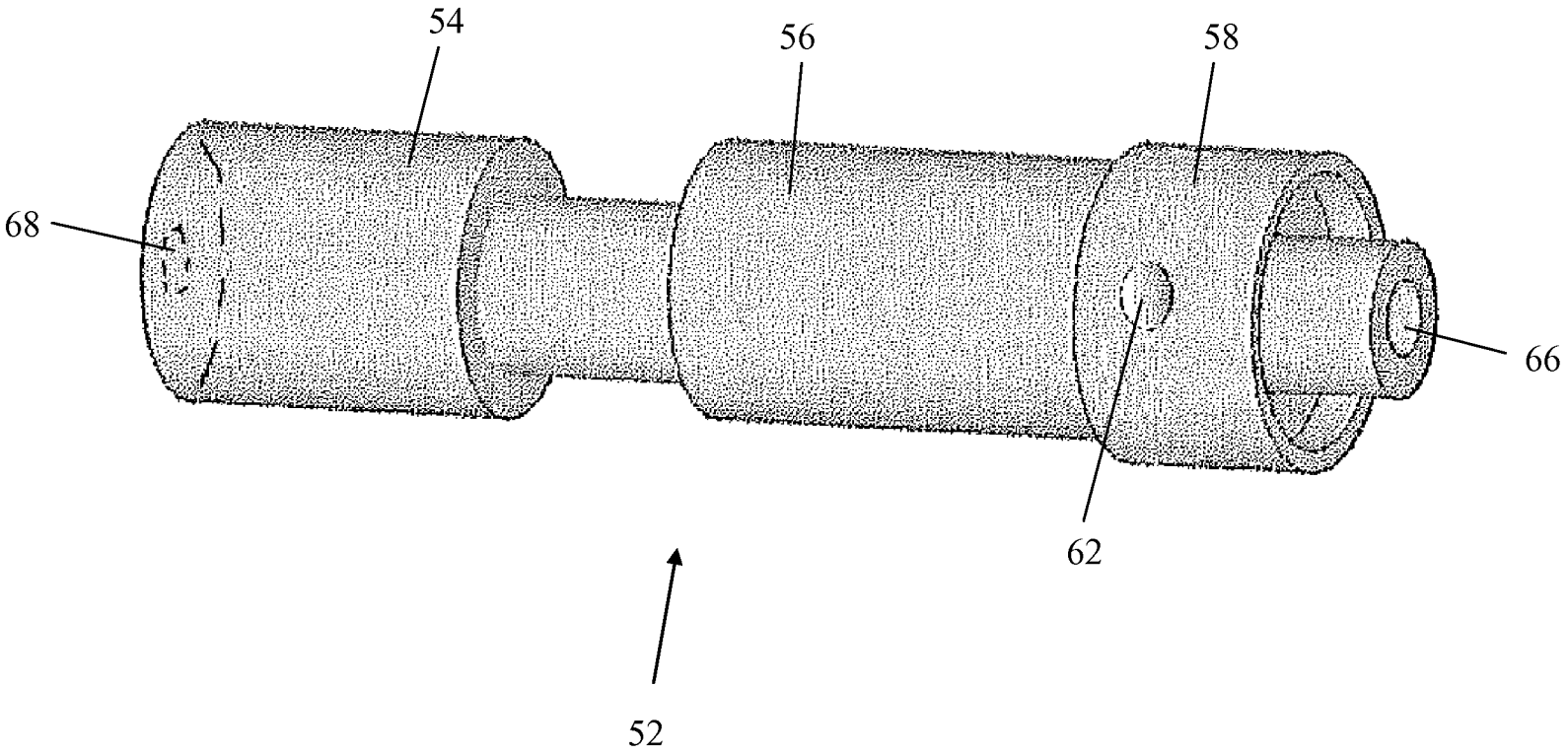
FIG. 7 illustrates a perspective view of an attachment kit of a chisel accessory, in accordance with an exemplary embodiment of the present disclosure.
Figure 8:
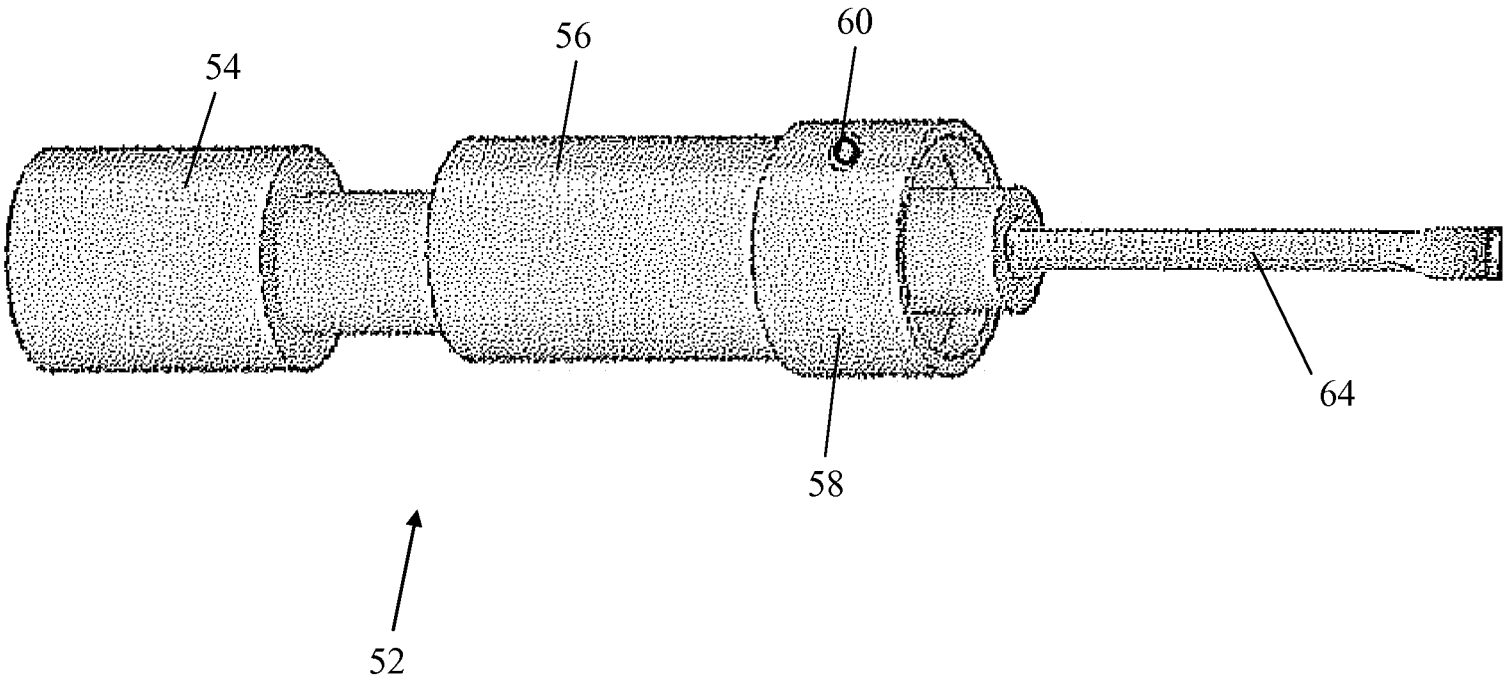
FIG. 8 illustrates a perspective view of an attachment kit and a chisel of a chisel accessory, in accordance with an exemplary embodiment of the present disclosure.

In an embodiment, a chisel 64 of the chisel accessory 50 is operatively coupled to the body piece 28 by means of an attachment kit 52. The attachment kit 52, which can be seen in greater detail in FIGS. 7 and 8, comprises a threaded attachment sleeve 54, a base piece 56, and a sliding lock piece 58. The threaded attachment sleeve 54 is located at an end of the attachment kit 52 proximate to the apparatus 24 and has a threaded recess for attachably receiving a threaded portion of the body piece 28. The threaded attachment sleeve 54 should be tightly installed onto the body piece 28 using a force-exerting tool, such as a wrench. The base piece 56, which may be disposed on a distal end of or at least partially within the threaded attachment sleeve 54, further comprises an engagement mechanism 60 (as will be discussed below), a striker aperture 68, and a chisel aperture 66, which striker aperture 68 is capable of receiving a striker 32 and which chisel aperture 66 is capable of receiving a chisel 64. The sliding lock piece 58 is located at an end of the attachment kit 52 distal from the apparatus 24 and further comprises an engagement aperture 62. The engagement aperture 62 is capable of receiving the engagement mechanism 60 of the base piece 56 to secure the chisel 64. In an embodiment, the engagement mechanism is a ball bearing. In an embodiment, the chisel 64 and chisel aperture 66 preferably comprises complementary engagement features that facilitate secure retention of the chisel 64 within at least a portion of the chisel aperture 66. In another embodiment, the engagement features may comprise at least one channel or groove disposed within at least a portion of the chisel 64 in which channel or groove a protrusion within the chisel aperture 66 may be received.

In use, the chisel accessory 50 transfers force generated by the apparatus 24 over an elongate portion such that the chisel 64 may impact a substrate using that force. The chisel accessory 50 is configured such that the full force (or substantially such force) originally exerted by the apparatus 24 on the extension rod 22 is imposed on the chisel 64. In an embodiment wherein the apparatus 24 is a palm nailer, a piston of the apparatus 24 generates a force from energy received by an energy source, such as an air compressor or battery, which force causes the nailing pin of the apparatus 24 to thrust forward within an aperture of the extension rod 22. The extension rod 22 receives the force from the nailing pin and translates it to the striker 32, which is fixedly disposed within the body piece 28. The striker 32 subsequently translates the force to the attachment kit 52, and, namely, to the striker aperture 68 in the base piece 56 of the attachment kit 52. The base piece 56 of the attachment kit 52, which also receives the chisel 64 within the chisel aperture 66 and maintains it in position therein, translates the force to the chisel 64, which utilizes that force to impact a substrate.

In an embodiment, a plurality of extension rods 22 and body pieces 28 may attach to one another to further extend the effective length and driving capability of an apparatus 24 utilizing the chisel accessory 50. To attach a second extension rod 22*a* and body piece 28*a* to a first extension rod 22 and body piece 28, the second extension rod 22*a* is placed with its proximate end adjacent to the first body piece 28 (with the attachment kit 52 and chisel 64 not being attached to the first extension rod 22 or body piece 28) such that the striker 32 of the first body piece 28 enters the small aperture within the proximate end of the second extension rod 22*a* and such that the locking mechanism of the second extension rod 22*a* may be disposed within the first body piece 28. A cap piece similar to the threaded attachment sleeve 54 of the attachment kit 52 is then threadably reattached in the original configuration of the threaded attachment sleeve 54, thereby securing the second extension rod 22 in place. It will be apparent that the plurality of extension rods 22 that are attached to one another are so attached to allow the force generated by the piston of the apparatus 24 to be fully or substantially translated to the chisel 64 at the end of the chisel accessory 50 that is distal to the apparatus 24. In this way, the movement of the chisel 64 is translated from the apparatus 24 successively through the various extension rods 22 until it reaches the chisel 64.

Figure 9:
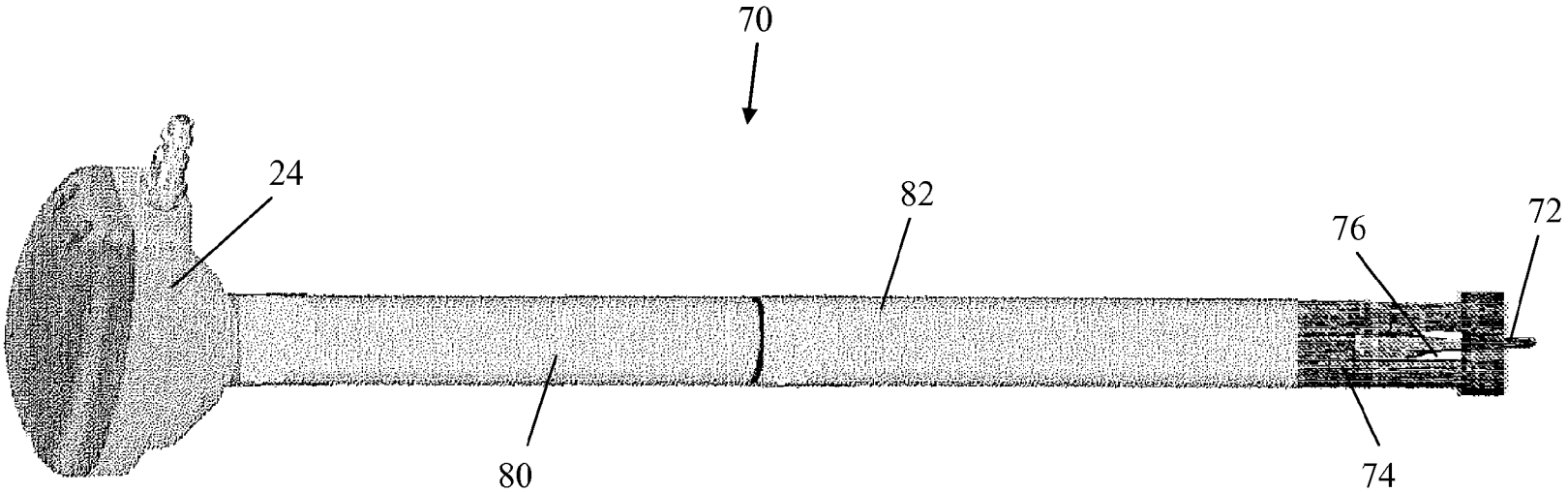
FIG. 9 illustrates a perspective view of a fastener driving apparatus assembled with a fastener setting accessory, in accordance with an exemplary embodiment of the present disclosure.
Figure 10:
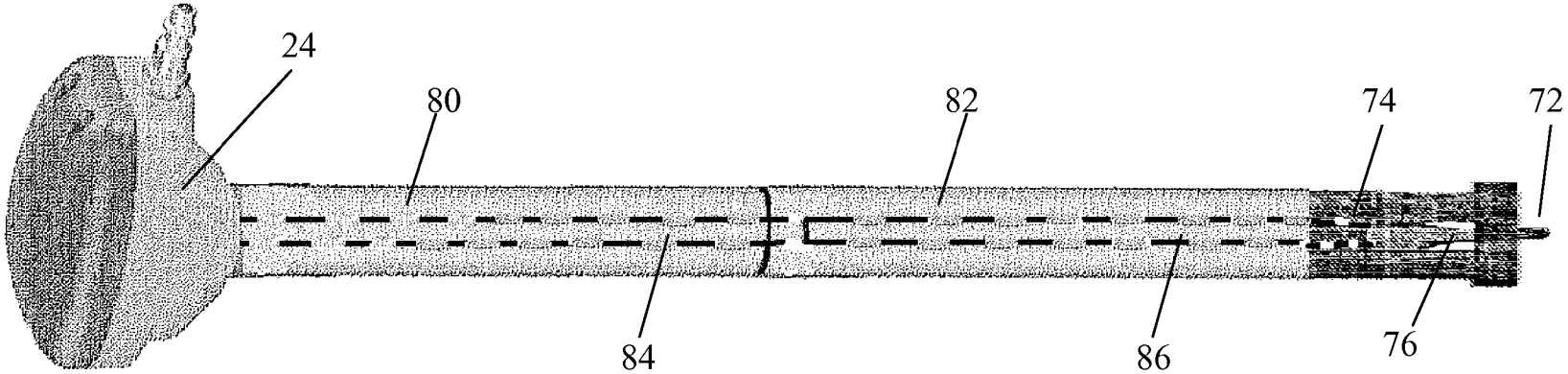
FIG. 10 illustrates a perspective view of a fastener driving apparatus assembled with a fastener setting accessory wherein outer components are shown in phantom, in accordance with an exemplary embodiment of the present disclosure.

Referring now to FIGS. 9 and 10, a fastener setting accessory 70 comprises an elongate device that may be removably attached to a fastener driving apparatus. The fastener setting accessory 70 may be operatively coupled to the apparatus to allow the apparatus to function as a fastener setting and depth regulation tool in addition to a chisel tool and a fastener driver. The fastener setting accessory 70 is adjustable to allow for the driving of a fastener into a substrate at a variety of selected depths and may work with a variety of fasteners, including, but not limited to, roofing nails, flooring nails, and finish nails. In an embodiment, the depth that the fastener setting accessory 70 allows a fastener to be set into a substrate may be adjusted at increments of 1/16 of an inch.

The fastener setting accessory 70 comprises an inner extension rod 84, an outer extension rod 80, an inner body piece 86, an outer body piece 82, and a depth guide 74. The outer extension rod 80 is an elongate piece that has a threaded portion at an end proximate to the fastener driving apparatus 24, which outer extension rod 80 operatively couples the fastener setting accessory 70 with the apparatus 24 via that threaded portion, which threaded portion is threadably received by the apparatus 24 where the magnetic nail guide holder of the apparatus is originally or otherwise typically disposed. The outer body piece 82 has a threaded portion at a proximate end that may be received by a threaded recess at a distal end of the outer extension rod 80 and a threaded recess at a distal end that may receive a threaded portion of the depth guide 74. The inner extension rod 84 is disposed within the outer extension rod 80 and with a proximate end adjacent to the apparatus 24. At a distal end of the inner extension rod 84 is a threaded portion capable of being received by a threaded recess of the inner body piece 86.

Figure 11:
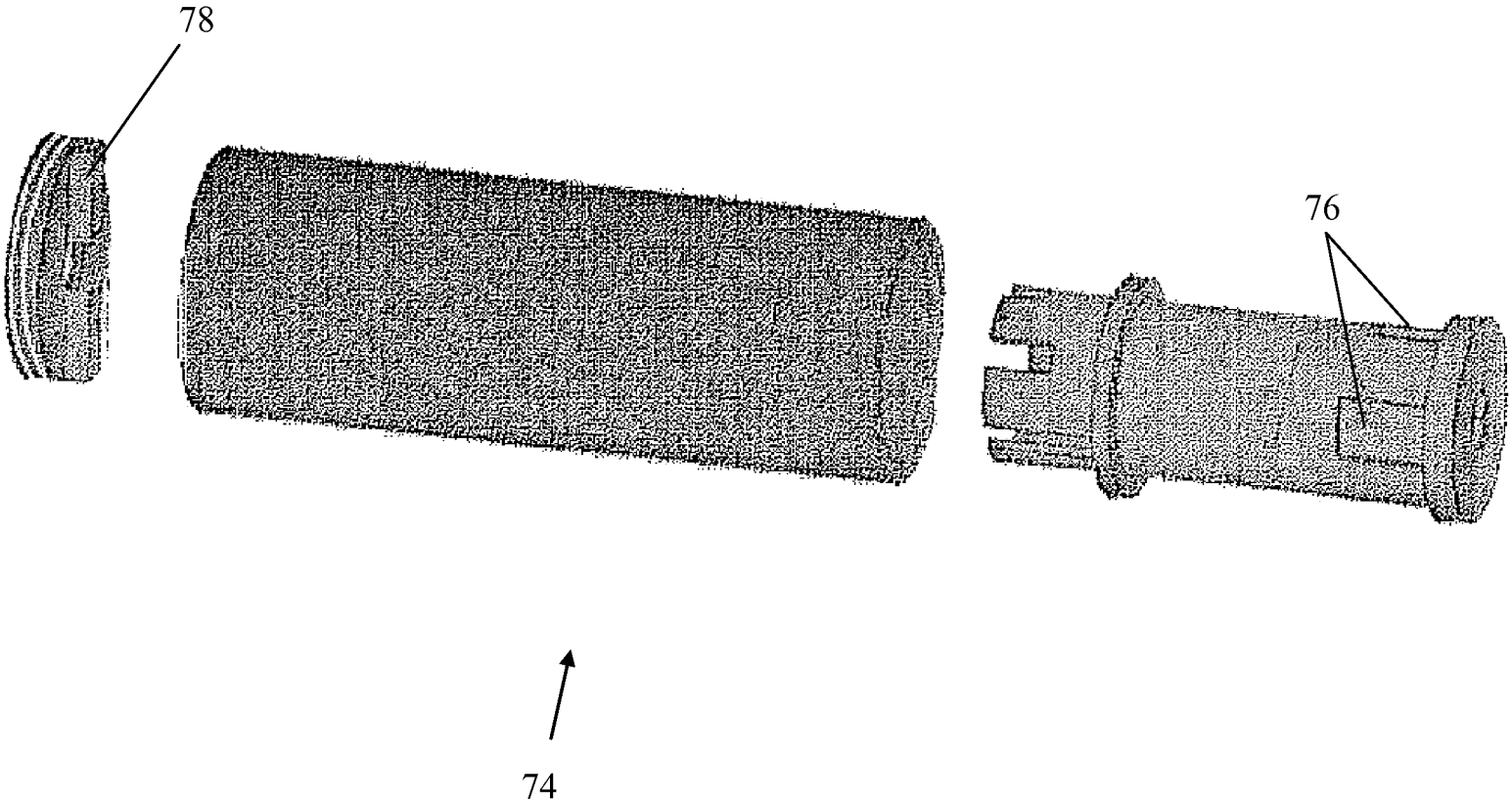
FIG. 11 illustrates a perspective, semi-exploded view of the components of a depth guide of a fastener setting accessory, in accordance with an exemplary embodiment of the present disclosure.

As shown in FIG. 11, the depth guide 74 comprises a plurality of viewing windows 76, which viewing windows 76 indicate the depth to which a fastener will be driven into a substrate. A desired viewing window 76 may be selected by rotating the depth guide 74 until that viewing window 76 is in the use position. The fastener setting accessory 70 is configured to allow at least a portion of a fastener to be driven through the depth guide 74 and further comprises an elevated ridge piece 78 on an interior portion of an end of the depth guide 74 proximate to the apparatus. The elevated ridge piece 78 prevents the head or flange of a fastener from being driven to a depth in the substrate further than is intended by the depth guide 74 by precluding the head or flange from traveling beyond the elevated ridge piece 78. The elevated ridge piece 78 and plurality of viewing windows 76, which are all disposed on, within, or about the depth guide 74, ensure that a fastener is set to a specified desired depth, which vastly increases the precision of work performed on a substrate.

In use, the fastener setting accessory 70 transfers force generated by the apparatus 24 over an elongate portion such that a striker 72, which is fixedly disposed at a distal end of the inner body piece 86, may impact a fastener pre-existing within a substrate using that force to drive that fastener to a select depth of the substrate. The fastener setting accessory 70 is designed such that the full force (or substantially all of such full force) originally exerted by the apparatus 24 on the inner extension rod 84 is imposed on the striker 72. In an embodiment wherein the apparatus 24 is a palm nailer, a piston of the apparatus 24 generates a force from energy received by an energy source, such as an air compressor or battery, which force causes the nailing pin of the apparatus 24 to thrust forward and strike the inner extension rod 84. The inner extension rod 84 receives the force from the nailing pin and translates it to the inner body piece 86 and thus to the striker 72. The striker 72 subsequently utilizes that force to impact a fastener and drive it to a specific, selected depth.

In an embodiment, a plurality of inner extension rods 84 and outer extension rods 80 may attach to one another to further extend the effective length and driving capability of an apparatus 24 utilizing the fastener setting accessory 70. As the components of the fastener setting accessory 70 are operatively coupled using threaded portions and recesses, the accessory 70 may be extended as desired by adding and attaching additional inner extension rods 84 and outer extension rods 80 in between the apparatus 24 and inner body piece 86 and outer body piece 82. It will be apparent that the plurality of inner extension rods 84 and outer extension rods 80 that are attached to one another are so attached to allow the force generated by the piston of the apparatus 24 to be substantially if not fully translated to the striker 72 at the end of the inner body piece 86 that is distal to the apparatus 24. In this way, the movement of the striker 72 is effected by translation from the apparatus 24 successively through the various inner extension rods 84 and outer extension rods 80 until it reaches the striker 72.

The foregoing descriptions of specific embodiments of the present disclosure have been presented for purposes of illustration and description. They are not intended to be exhaustive or to limit the disclosure to the precise forms disclosed, and obviously many modifications and variations are possible in light of the above teaching. The exemplary embodiment was chosen and described in order to best explain the principles of the disclosure and its practical application, to thereby enable others skilled in the art to best utilize the disclosure and various embodiments with various modifications as are suited to the particular use contemplated.

What is claimed is:

1. An extension system for a fastener driving device, the system comprising:

at least one extension rod, said at least one extension rod consisting of a first end and a second end, which first end is proximate to a fastener driving device to which said at least one extension rod may be attached, and which second end is distal to a fastener driving device, said at least one extension rod including an aperture for receiving a nailing pin of the fastener driving device;

a locking mechanism, said locking mechanism disposed at said first end of said at least one extension rod, said locking mechanism capable of securely attaching said at least one extension rod to the fastener driving device such that said at least one extension rod is operatively coupled with the fastener driving device;

at least one body piece, said at least one body piece having a first end and a second end, said first end of said at least one body piece disposed on said second end of said at least one extension rod such that said at least one body piece is not in physical contact with said locking mechanism when so disposed on said second end of said at least one extension rod;

a cap piece, said cap piece removably attachable to said second end of said at least one body piece;

a striker, said striker disposed within at least one of said at least one body piece and said cap piece, said striker capable of striking a fastener to drive the fastener into a substrate;

a sleeve, said sleeve disposed within at least one of said at least one body piece and said cap piece, said sleeve capable of receiving at least one fastener therein, said sleeve having a striker aperture for receiving at least a portion of said striker therein; and a biasing member, said biasing member disposed within at least one of said at least one body piece and said cap piece, said biasing member capable of moving or retaining said sleeve to or in a retracted position before or after said striker strikes the fastener, wherein when the fastener driving device imparts a force to said at least one extension rod, said at least one extension rod transfers the force to said striker, and said striker utilizes the force to drive the fastener into the substrate.

2. The system as claimed in claim 1, wherein said sleeve further comprises a fastener retention mechanism.

3. The system as claimed in claim 2, wherein said fastener retention mechanism comprises at least one of a magnet.

4. The system as claimed in claim 1, wherein said sleeve further comprises a fastener guide.

5. The system as claimed in claim 1, wherein said locking mechanism is operatively coupled to and received directly by a magnetic nail guide holder of the fastener driving device, and wherein said locking mechanism removably attaches said extension system to the fastener driving device.

6. The system as claimed in claim 5, wherein said locking mechanism comprises at least one of a static locking ring and a removable locking ring.

7. The system as claimed in claim 1, wherein a plurality of extension rods and body pieces are attached to one another and are operatively coupled to a fastener driving device.

8. An extension system for a fastener driving device, said device capable of driving a fastener into a substrate, the system comprising:

at least one extension rod, said at least one extension rod consisting of a first end and a second end, which first end is proximate to a fastener driving device to which said at least one extension rod may be attached, and which second end is distal to a fastener driving device, said at least one extension rod including an aperture for receiving a nailing pin of the fastener driving device;

a locking mechanism, said locking mechanism disposed at said first end of said at least one extension rod, said locking mechanism capable of securely attaching said at least one extension rod to the fastener driving device such that said at least one extension rod is operatively coupled with the fastener driving device;

at least one body piece, said at least one body piece having a first end and a second end, said first end of said at least one body piece disposed on said second end of said extension rod such that said at least one body piece is not in physical contact with said locking mechanism when so disposed on said second end of said at least one extension rod;

an attachment kit, said attachment kit having a first end and a second end, said first end of said attachment kit removably attached to said second end of said at least one body piece, said attachment kit capable of receiving at least a portion of a chisel therein;

a striker, said striker disposed within at least one of said at least one body piece and said attachment kit, said striker capable of striking a chisel; and a chisel, said chisel capable of striking a substrate, wherein when the fastener driving device imparts a force to said at least one extension rod, said at least one extension rod transfers the force to said striker, and said striker transfers the force to said chisel such that said chisel may move away from the fastener driving device and impact a substrate.

9. The system as claimed in claim 8, wherein said attachment kit further comprises a threaded attachment sleeve, a base piece, and a sliding lock piece, said threaded attachment sleeve disposed at said first end of said attachment kit, said sliding lock piece disposed at said second end of said attachment kit, said base piece disposed between said threaded attachment sleeve and said sliding lock piece.

10. The system as claimed in claim 9, wherein said base piece further comprises an engagement mechanism, a striker aperture, and a chisel aperture, said striker aperture capable of receiving at least one of said striker and the nailing pin of the fastener driving device, said chisel aperture capable of receiving said chisel.

11. The system as claimed in claim 10, wherein said sliding lock piece further comprises an engagement aperture, said engagement aperture capable of receiving said engagement mechanism.

12. The system as claimed in claim 11, wherein said engagement mechanism is a ball bearing.

13. The system as claimed in claim 8, wherein said locking mechanism is operatively coupled to a magnetic nail guide holder of the fastener driving device, and wherein said locking mechanism removably attaches said extension system to the fastener driving device.

14. The system as claimed in claim 13, wherein said locking mechanism comprises at least one of a static locking ring and a removable locking ring.

15. The system as claimed in claim 8, wherein a plurality of extension rods and body pieces are attached to one another and are operatively coupled to a fastener driving device.

* * * * *